US006238057B1

(12) United States Patent
Chen

(10) Patent No.: US 6,238,057 B1
(45) Date of Patent: May 29, 2001

(54) COMBINATION LIGHT PEN

(75) Inventor: Johnson Chen, Taipei (TW)

(73) Assignee: Wiering Industries, Inc., Taipei (TW)

( * ) Notice: Subject to any disclaimer, the term of this patent is extended or adjusted under 35 U.S.C. 154(b) by 0 days.

(21) Appl. No.: 09/662,069

(22) Filed: Sep. 14, 2000

(51) Int. Cl.[7] ..... B43K 29/10
(52) U.S. Cl. ..... 362/118; 362/101
(58) Field of Search ..... 362/101, 118, 362/109, 318, 253, 806; 401/52, 192, 195, 141, 142; 40/334, 406

(56) References Cited

U.S. PATENT DOCUMENTS 2,264,194 * 11/1941 Wuestman ..... 40/334
5,413,429 * 5/1995 Shiau ..... 401/195
5,673,996 * 10/1997 Ducker ..... 362/118

* cited by examiner

*Primary Examiner*—Y. Quach
(74) *Attorney, Agent, or Firm*—Pro-Techtor International Services

(57) ABSTRACT

A combination light pen, which includes an upper barrel, a pen cap and a connector fastened to top and bottom ends of the upper barrel, a LED and battery circuit assembly mounted in the upper barrel, a push-button switch mounted in the pen cap and operated to turn on/off the LED, a transparent lower barrel fastened to the connector to hold an ink cartridge and a transparent conical socket, wherein the lower barrel comprises a water chamber disposed around the ink cartridge, a liquid filled in the water chamber, and display items floating in the liquid inside the water chamber.

3 Claims, 6 Drawing Sheets

COMBINATION LIGHT PEN

BACKGROUND OF THE INVENTION

The present invention relates to a combination light pen, and more particularly to such a combination light pen, which comprises a water chamber defined in a lower barrel around an ink cartridge, and display items floating in a liquid in the water chamber.

Conventionally, a pen is simply a writing instrument used in writing with ink. However, it is not practical to write with a pen in the dark. There are commercially available light pens, which provide sufficient illumination when writing in the dark. These light pens commonly comprise a bulb, a battery, and a button controlled to connect/disconnect the circuit between the bulb and the battery. However, because these light pens provide the same effect, a special design or an added function must be provided so as to attract consumers to buy.

SUMMARY OF THE INVENTION

It is the main object of the present invention to provide a combination light pen, which produces an attractive advertising effect when operated to emit light. According to one aspect of the present invention, the combination light pen comprises an upper barrel, a pen cap and a connector fastened to top and bottom ends of the upper barrel, a LED and battery circuit assembly mounted in the upper barrel, a push-button switch mounted in the pen cap and operated to turn on/off the LED, a transparent lower barrel fastened to the connector to hold an ink cartridge and a transparent conical socket, wherein the lower barrel comprises a water chamber disposed around the ink cartridge, a liquid filled in the water chamber, and display items floating in the liquid inside the water chamber. According to another aspect of the present invention, graphic device means is provided at an inside wall of the lower barrel around the longitudinal receiving hole for advertising.

BRIEF DESCRIPTION OF THE DRAWINGS

FIG. 4 is a sectional view of the present invention, showing the writing tip extended out of the transparent conical socket, the LED turned on.

DETAILED DESCRIPTION OF THE PREFERRED EMBODIMENT

Figure 1:
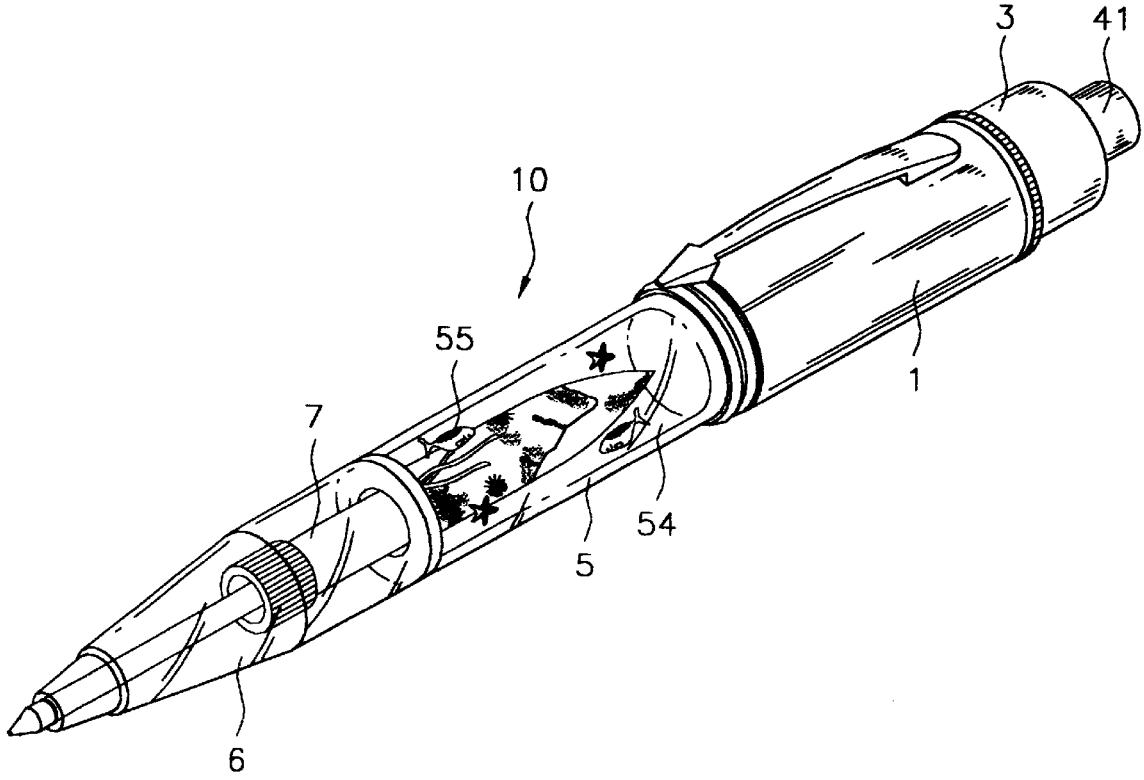
FIG. 1 is a perspective view of a combination light pen according to the present invention.
Figure 2:
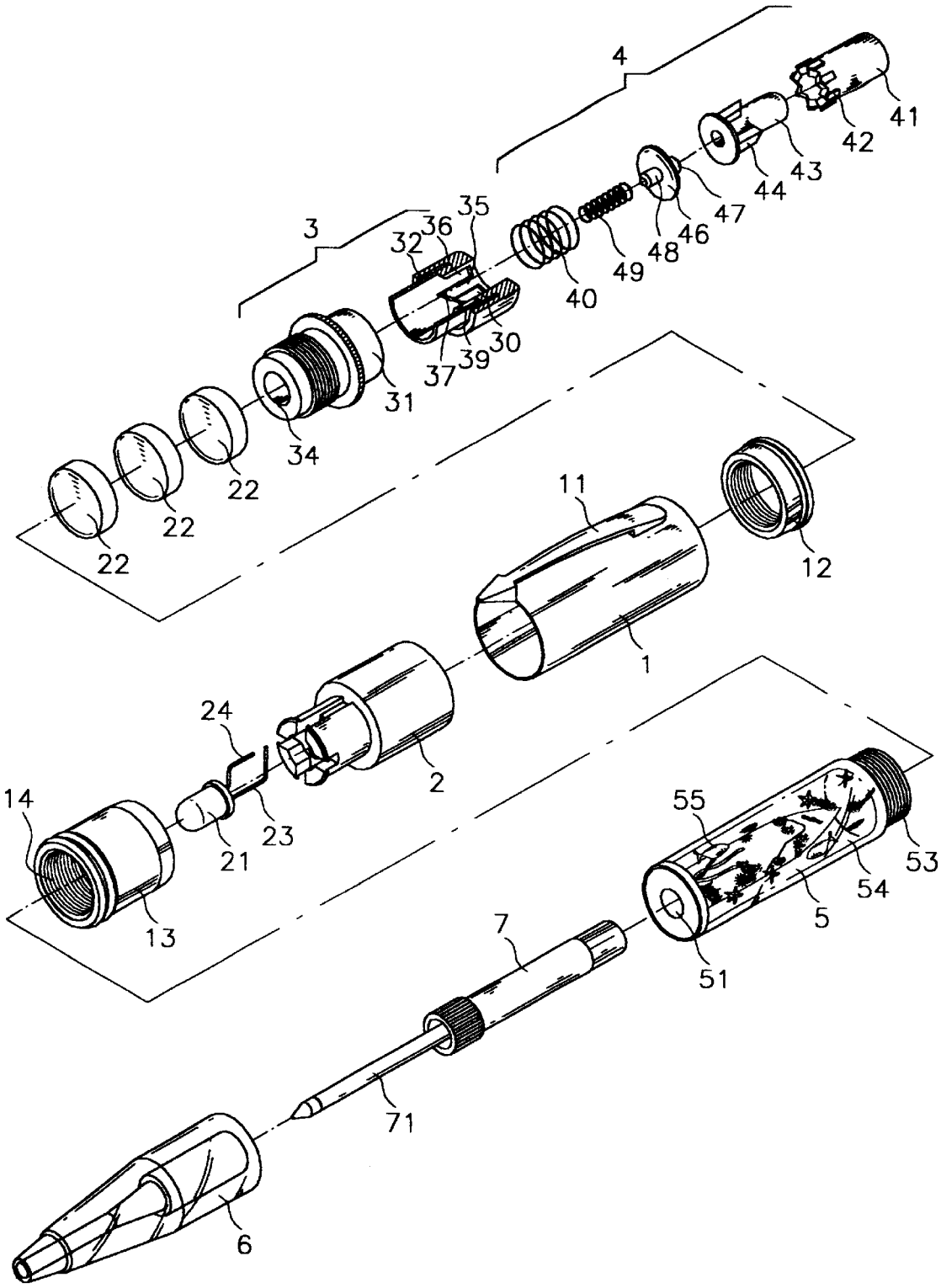
FIG. 2 is an exploded view of the combination light pen shown in FIG. 1.
Figure 3:
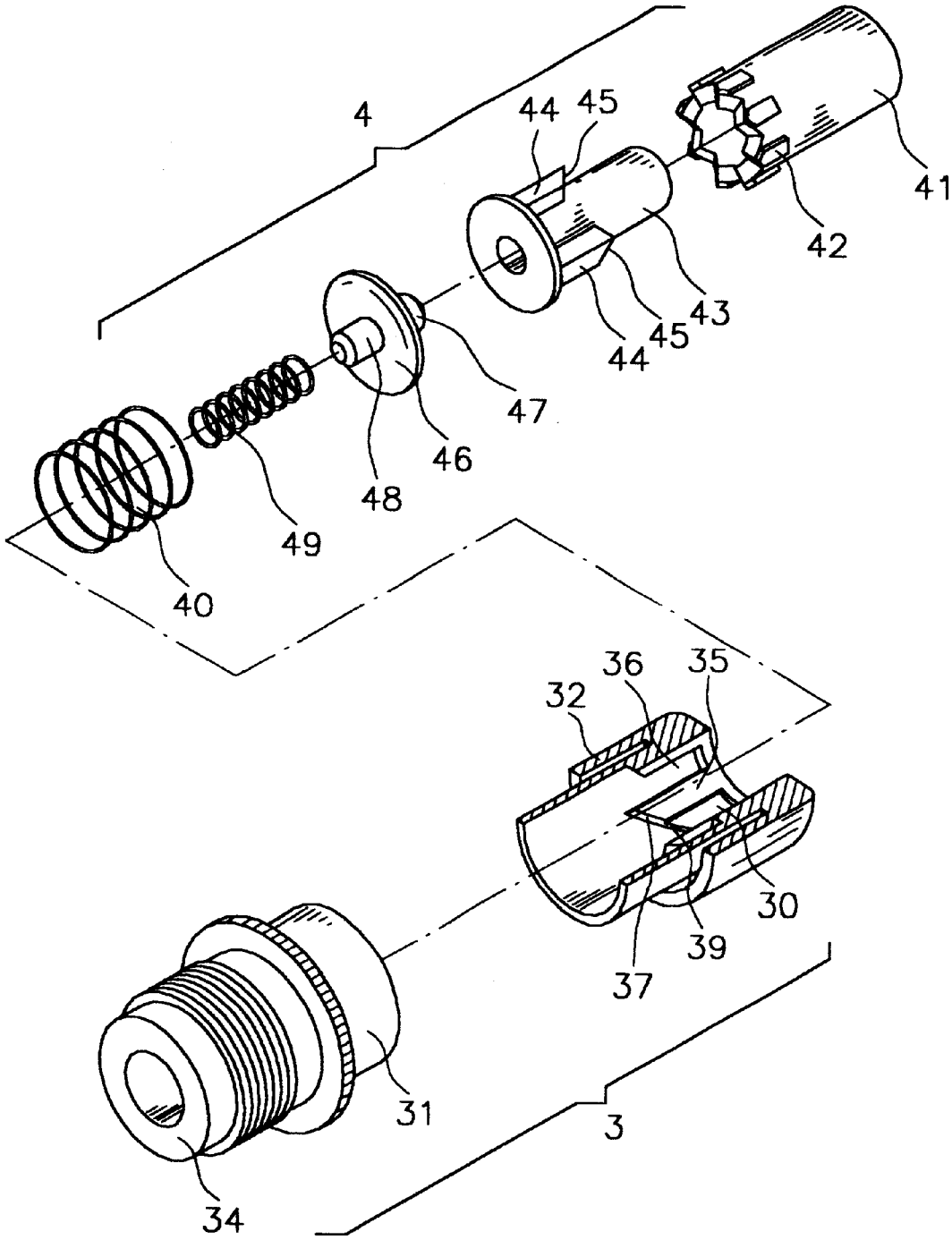
FIG. 3 is an exploded view of the pen cap assembly and the push-button switch for the combination light pen according to the present invention.
Figure 4:
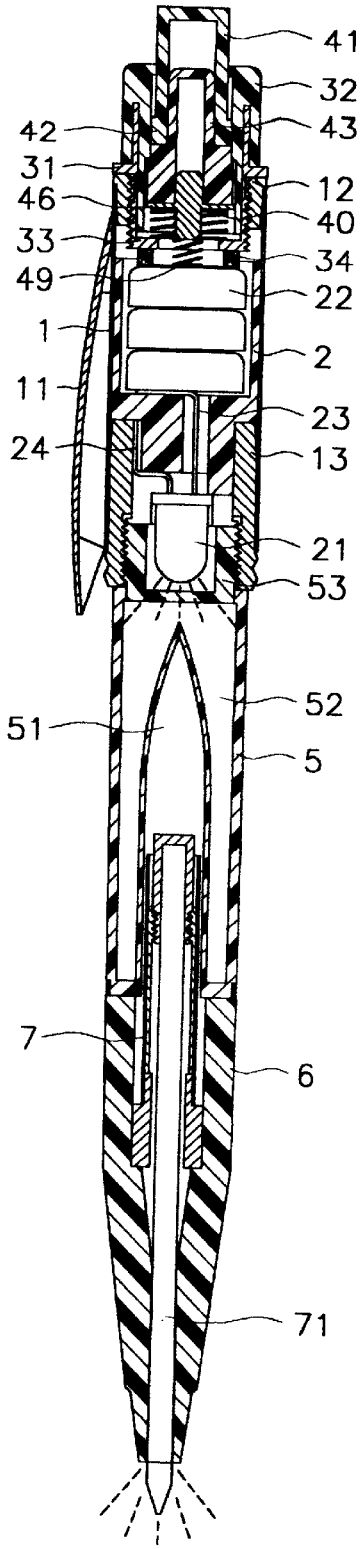
Figure 5:
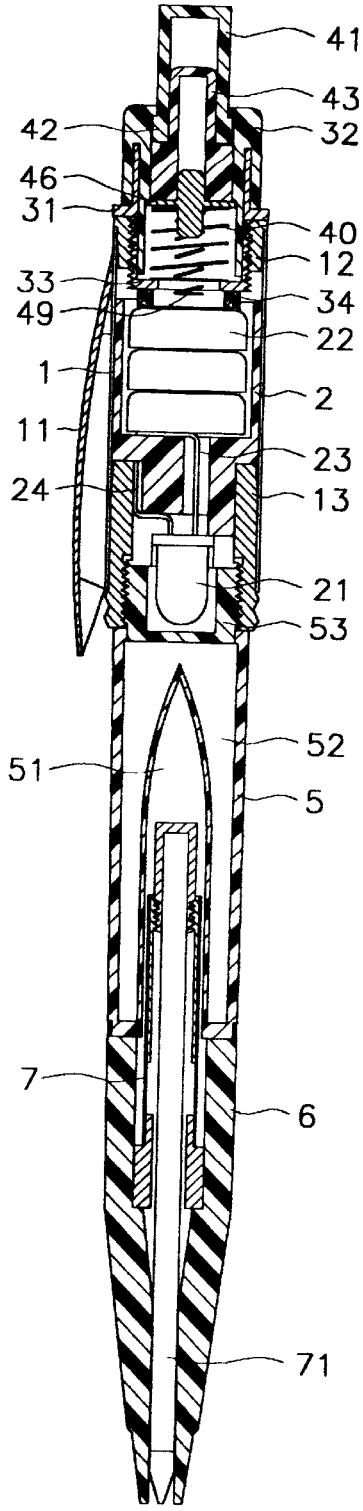
FIG. 5 is another sectional view of the present invention, showing the writing tip received inside the transparent conical socket, the LED turned off.

Referring to FIGS. 1 through 4, a combination light pen 10 in accordance with the present invention comprises a metal upper barrel 1 having a clip 11 on the outside, a bushing 2 mounted in the upper barrel 1 to hold a LED (light emitting diode) 21 and a set of battery cells 22, a metal nut 12 mounted in the upper barrel 1 and spaced above the bushing 2 to hold a pen cap assembly 3 and a push button switch 4 in the pen cap assembly 3, a metal connector 13 coupled to one end of the bushing 2 and extended out of one end of the upper barrel 1, a lower barrel 5 connected to one end of the connector 13 outside the upper barrel 1, a transparent conical socket 6 coupled to one end of the lower barrel 5 opposite to the connector 13, and an ink cartridge 7 mounted in the lower barrel 5 and the conical socket 6. The ink cartridge 7 comprises a writing tip 71 at the front end thereof. The writing tip 71 is moved with the ink cartridge 7 in and out of the conical socket 6 upon rotary motion of the conical socket 6. The push button switch 4 is operated to turn on/off the LED 21. The pen cap assembly 3 is comprised of a threaded sleeve 31, and a cap 32. The LED 21 has a positive lead-out leg 23 disposed in contact with the positive terminal of the series of battery cells 22, and a negative lead-out leg 24 retained in between the bushing 2 and the connector 13. Further, a flexible, annular, electrically conducting cushion 34 is retained between the threaded sleeve 31 and the series of battery cell 22.

Referring to FIGS. 3 and 4 again, the push button switch 4 comprises a hollow, cylindrical button 41 extended out of the pen cap assembly 3 for operation, the cylindrical button 41 having 8 longitudinal ribs 42 equiangularly spaced around the periphery of the bottom end thereof, a socket 43 inserted into the button 41 from the bottom side, the socket 43 comprising 4 longitudinal ribs 44 equiangularly spaced around the periphery of the bottom end thereof, the longitudinal ribs 44 each having a beveled top edge 45, a disk 46 having a top center rod 47 inserted into the socket 43 from the bottom side and a bottom center rod 48, a metal contact spring 49 having a top end coupled to the bottom center rod 48 and a bottom end aimed at the negative terminal of the series of battery cells 22, and a return spring 40 mounted around the metal contact spring 49 and stopped between the disk 46 and an inside step 33 in the threaded sleeve 31 of the pen cap assembly 3 for returning the socket 43 to its former position after an operation of the push button switch 4. The cap 32 of the pen cap assembly 3 comprises 8 longitudinal ribs 35 equiangularly spaced around the inside wall thereof, the longitudinal ribs 35 each having a beveled bottom edge 37 respectively matching the beveled top edge 45 at each of the longitudinal ribs 44 at the socket 43 of the push button switch 4 to guide the movement of the socket 43, 4 longitudinal sliding grooves 36 and 4 longitudinal locating grooves 30 alternatively arranged around the inside wall and spaced by the longitudinal ribs 35. The longitudinal sliding grooves 36 receive the longitudinal ribs 42 of the push button 41 and the longitudinal ribs 44 of the socket 43. The depth of the longitudinal locating grooves 30 is shallower than the longitudinal sliding grooves 36, each having a stop edge 39 at one end respectively matching the beveled top edge 45 at each of the longitudinal ribs 44 of the socket 43.

Figure 6A:
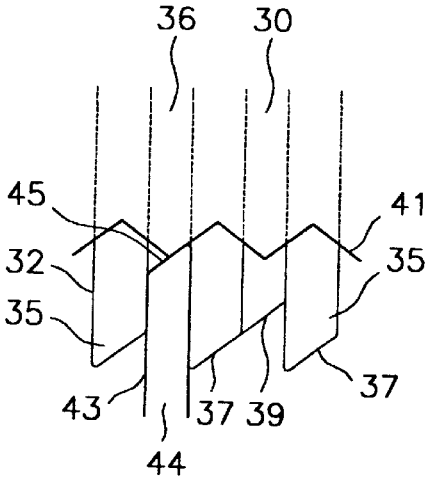
FIGS. 6A~6D explains the operation of the push-button switch according to the present invention.
Figure 6B:
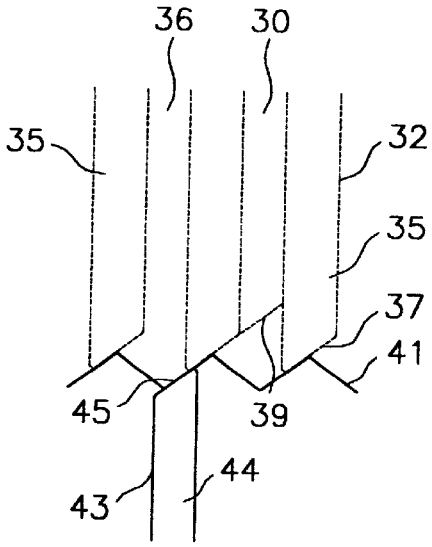
Figure 6C:
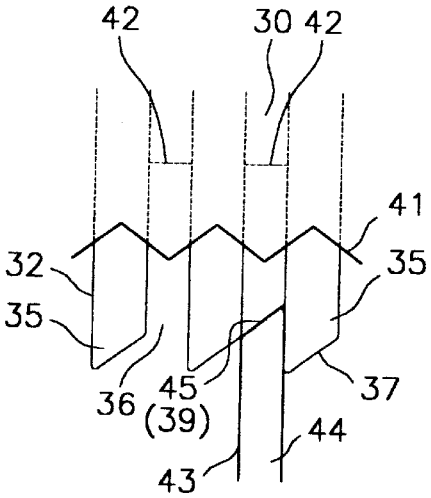
Figure 6D:
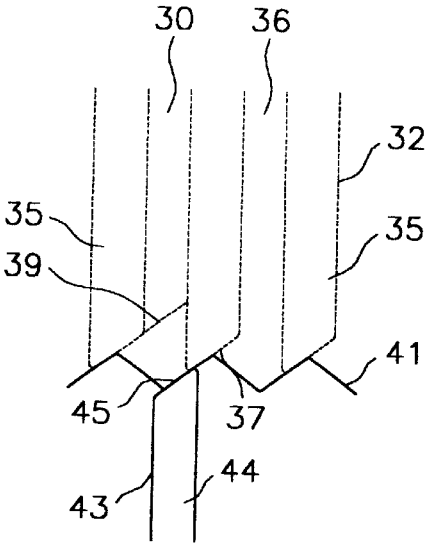

Referring to FIG. 5 and FIGS. 6A through 6D and FIG. 4 again, when the button 41 is depressed, see FIG. 6A, the socket 43 is moved downwards with the button 41 along the longitudinal sliding grooves 36 on the cap 32. When the longitudinal ribs 44 are lowered with the socket 43 to the elevation below the longitudinal ribs 35 at the cap 32 (see FIG. 6B), the longitudinal ribs 44 are respectively moved with the socket 43 to the longitudinal ribs 35 at the cap 32, and guided by the beveled bottom edge 37 at each of the longitudinal ribs 35 to the longitudinal locating grooves 30 and then stopped at the stop edge 39 at the bottom end of each of the longitudinal locating grooves 30 (see FIG. 6C), thereby causing the socket 43 to be stopped in place, and the metal contact spring 49 to be forced into contact with the negative terminal of the series of battery cells 22 (see FIG. 4), and therefore the disk 46, the return spring 40, the threaded sleeve 31, the metal nut 12, the upper barrel 1 and the metal connector 13 are electrically connected in series to the negative terminal of the series of battery cells 22 and the negative lead-out leg 24 of the LED 21, and the LED 21 is thus turned on. When the button 41 is pressed down further, the socket 43 and the button 41 are synchronously lowered, causing the longitudinal ribs 44 to be moved away from the stop edge 39 at the bottom end of each of the longitudinal locating grooves 30 to the elevation below the longitudinal ribs 35 at the cap 32 (see FIG. 6D). Due to the effect of the return spring 40, the longitudinal ribs 44 are then moved with the socket 43 along the beveled bottom edge 37 at each of the longitudinal ribs 35 into the longitudinal sliding grooves 36 (see FIG. 6A), and therefore the socket 43 is returned to its former position, and the metal contact spring 49 is disconnected from the series of battery cells 22 (see FIG. 5), causing the LED 21 to be turned off.

Referring to FIGS. 2, 4 and 5 again, the metal connector 13 has an inner thread 14 threaded onto a threaded neck 53 at the top end of the lower barrel 5. The lower barrel 5 is made of transparent material, having a tapered longitudinal receiving hole 51, which receives the upper part of the ink cartridge 7. The lower end of the ink cartridge 7 is inserted into the conical socket 6, enabling the conical socket 6 to be supported on the bottom end of the lower barrel 5, and rotated between a first position where the writing tip 71 is extended out of the conical socket 71 (see FIG. 4), and the second position wherein the writing tip 71 is received inside the conical socket 6. The ink cartridge 7 is of the known art. In order to fit the ink cartridge 7, the lower barrel 5 and the conical socket 6 must be separately fabricated, and then respectively coupled to the ink cartridge 7. Alternatively, the lower barrel 5 and the conical socket 6 can be formed integral with each other when a fixed ink cartridge is used.

Figure 7:
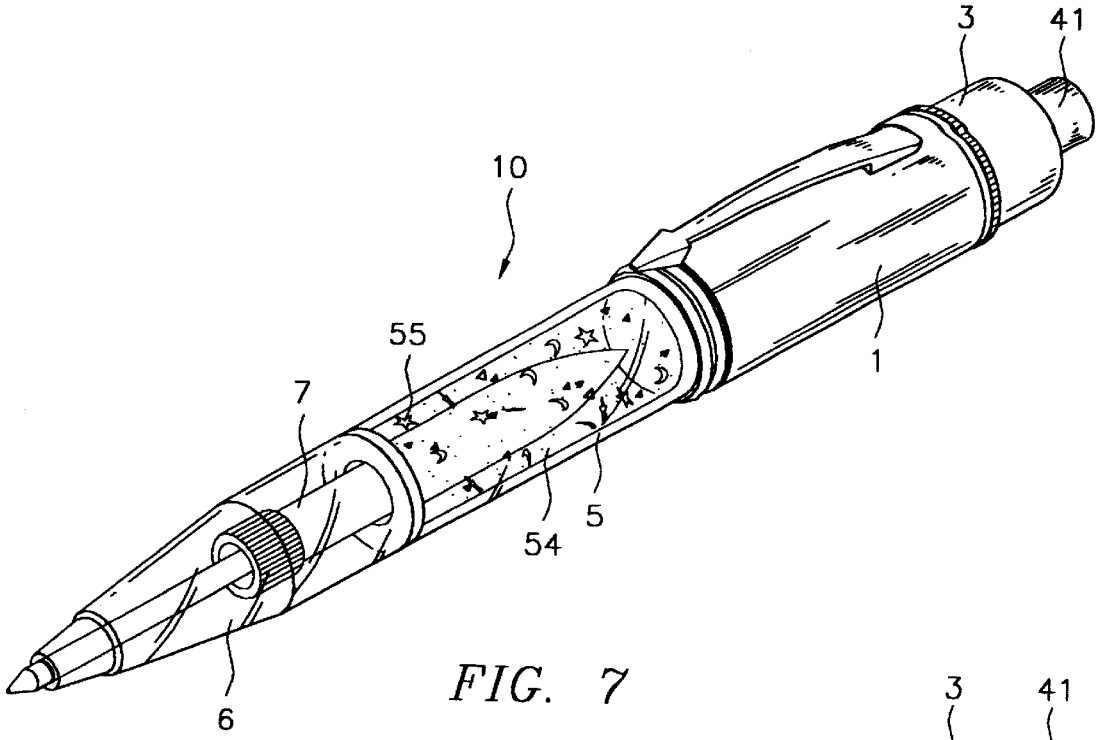
FIG. 7 is a perspective view of an alternate form of the combination light pen according to the present invention.

Referring to FIG. 7 and FIGS. 1 and 4 again, the lower barrel 5 comprises a water chamber 52 disposed around the tapered longitudinal receiving hole 51, a liquid 54 filled in the water chamber 52, and display items 55 floating in the liquid 54 inside the water chamber 52. The display items 55 can have any of a variety of shapes. For example, the display items 55 can have the shape of fish. When shaking the combination light pen after the LED 21 has been turned on, the display items 55 are moved in the liquid 54 inside the water chamber 52, and light from the LED 21 passes through the water chamber 52 to illuminate the display items 55.

Figure 8:
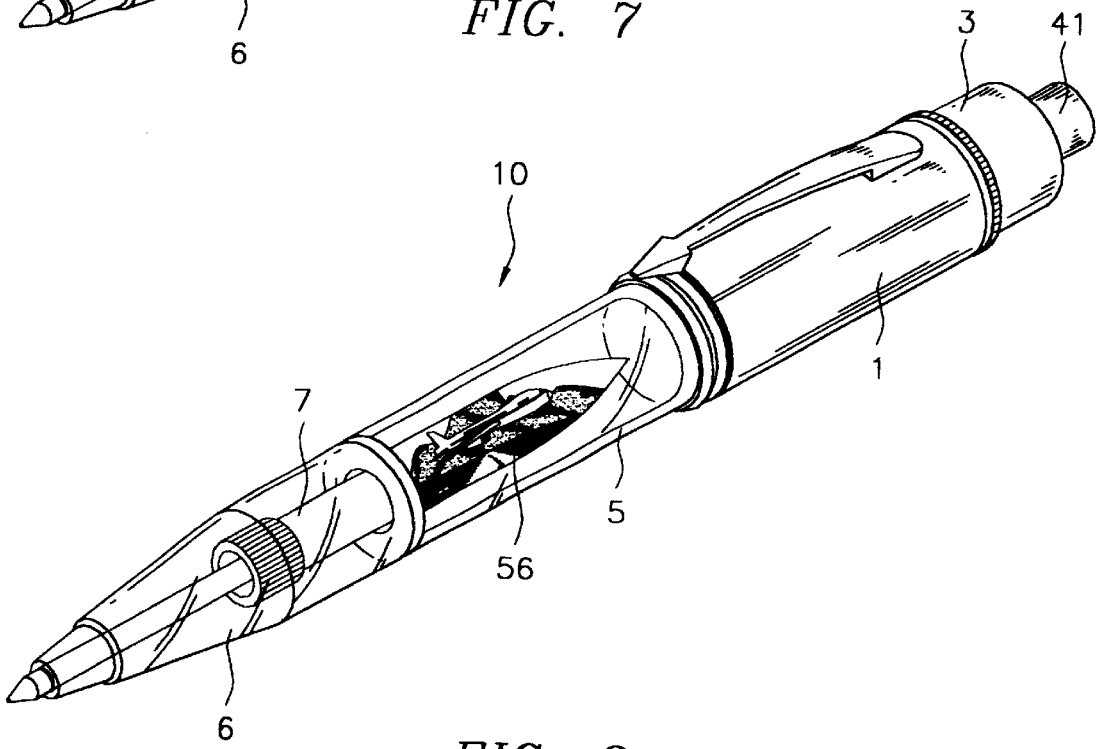
FIG. 8 is a perspective view of another alternate form of the combination light pen according to the present invention.

Referring to FIG. 8, a product blurb or graphic device 56 may be provided at the inside wall of the lower barrel 5 around the longitudinal receiving hole 51.

Referring to FIG. 4 again, the threaded neck 53 can be a plug member sealing the top opening of the water chamber 52. After filling of the liquid 54 in the water chamber 52, the threaded neck 53 is fastened to the lower barrel 5 to seal the top opening of the water chamber 52. The threaded neck 53 can be fastened to the lower barrel 5 by, for example, ultrasonic sealing technique.

It is to be understood that the drawings are designed for purposes of illustration only, and are not intended as a definition of the limits and scope of the invention disclosed.

What the invention claimed is:

1. A combination light pen of the type comprising:

a metal upper barrel having a top end mounted with a metal nut and a bottom end mounted with a metal connector;

a metal bushing mounted inside said upper barrel;

a battery set mounted in said bushing;

a light emitting diode supported in said bushing, said light emitting diode having a positive lead-out leg connected to the positive terminal of said battery set and a negative lead-out leg connected between said bushing and said connector;

metal pen cap means fastened to the nut at the top end of said upper barrel;

push-button switch means mounted in said pen cap means and extended out of said pen cap means for operation with the hand to connect/disconnect a circuit between said battery set and said light emitting diode;

a transparent lower barrel connected to the connector at the bottom end of said upper barrel by a joint member, said lower barrel comprising a longitudinal receiving hole;

a transparent socket; and an ink cartridge having an upper end inserted into the longitudinal receiving hole in said lower barrel and a lower end of the ink cartridge inserted into said transparent socket for enabling said transparent socket to be supported on said lower barrel and rotated to reciprocate said ink cartridge;

wherein said lower barrel comprises a water chamber disposed around said longitudinal receiving hole, a liquid filled in said water chamber, and display items floating in said liquid inside said water chamber.

2. The combination light pen of claim 1 wherein said lower barrel comprises graphic device means provided at an inside wall of the lower barrel around said longitudinal receiving hole.

3. The combination light pen of claim 1 wherein said water chamber of said lower barrel has a top opening sealed with said joint member comprised of a plug member, said plug member having an outer thread threaded into an inner thread in said connector.

* * * * *